US007121244B2

(12) United States Patent
Roe et al.

(10) Patent No.: US 7,121,244 B2
(45) Date of Patent: Oct. 17, 2006

(54) ANTI-ROTATION GUIDE FOR A ROLLER FOLLOWER VALVE LIFTER

(75) Inventors: Richard B. Roe, Henrietta, NY (US); Ralph L. Clayson, Grand Rapids, MI (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 10/729,506

(22) Filed: Dec. 5, 2003

(65) Prior Publication Data

US 2004/0194739 A1 Oct. 7, 2004

Related U.S. Application Data

(60) Provisional application No. 60/459,737, filed on Apr. 2, 2003.

(51) Int. Cl.
*F01L 1/14* (2006.01)

(52) U.S. Cl. ..... 123/90.5; 123/90.15; 123/90.28; 123/90.39

(58) Field of Classification Search .. 123/90.15–90.18, 123/90.28, 90.39–90.59
See application file for complete search history.

(56) References Cited

U.S. PATENT DOCUMENTS 3,584,611 A * 6/1971 Miller, Jr. ..... 123/90.19
3,822,683 A * 7/1974 Clouse ..... 123/90.5
4,173,954 A * 11/1979 Speckhart ..... 123/90.5
4,207,775 A * 6/1980 Lintott ..... 74/55
4,326,484 A * 4/1982 Amrhein ..... 123/90.5
4,406,257 A * 9/1983 Keske et al. ..... 123/90.48
4,448,155 A * 5/1984 Hillebrand et al. ..... 123/90.5
4,793,295 A * 12/1988 Downing ..... 123/90.5
4,809,651 A * 3/1989 Gerchow et al. ..... 123/90.5
5,178,107 A * 1/1993 Morel et al. ..... 123/90.35
5,263,386 A * 11/1993 Campbell et al. ..... 74/569

* cited by examiner

*Primary Examiner*—Thomas Denion
*Assistant Examiner*—Zelalem Eshete
(74) *Attorney, Agent, or Firm*—Patrick M. Griffin

(57) ABSTRACT

An anti-rotation guide for preventing rotation of a roller follower valve lifter in an internal combustion engine. The guide has an outer surface for engaging an engine bore and an inner surface for slidably receiving the lifter. One end of the guide includes an anti-rotation feature for cooperating with a mating feature on the lifter, preferably flats although other configurations are contemplated within the scope of the invention. The anti-rotation feature may take any of a plurality of shapes, including but not limited to an arm and tang, a flap, and an orifice flat. The guide is installed from an opening in the engine bore proximate a camshaft disposed in the engine block. The cooperating features prevent axial rotation of a lifter within the sleeve but do not inhibit axial or reciprocal motion of the lifter.

13 Claims, 4 Drawing Sheets

ANTI-ROTATION GUIDE FOR A ROLLER FOLLOWER VALVE LIFTER

RELATIONSHIP TO OTHER APPLICATIONS AND PATENTS

The present application draws priority from a pending U.S. Provisional Application, Ser. No. 60/459,737, filed Apr. 2, 2003.

TECHNICAL FIELD

The present invention relates to internal combustion engines; more particularly, to devices for preventing axial rotation of valve lifters; and most particularly, to a sleeved anti-rotation guide which prevents rotation of a roller follower valve lifter in an internal combustion engine.

BACKGROUND OF THE INVENTION

Hydraulic valve lifters and solid valve lifters, for use in internal combustion engines, are well known in the engine art. A valve lifter of this type, engaging a camshaft lobe at one end and a push-rod or valve stem at the other end, slides reciprocally in a bore of the engine block. The lifter, typically assembled from the top side of the engine block, engages a camshaft lobe via a camshaft follower end which preferably includes a roller. Unless suitably constrained by an anti-rotation guide, a roller follower lifter may rotate axially in its bore during reciprocation, thereby undesirably misaligning its roller follower from the associated cam lobe.

Lifter anti-rotation guides in the prior art are positioned on and secured to the top side surface of the engine block adjacent the lifter bore. When fastened to the engine block above the lifter, a closely-fitting aperture in the anti-rotation guide snuggly surrounds an end of the lifter exposed above the engine block opposite the roller follower end. A locating feature in the guide aperture, such as a flat or a keyway, mates with a similar feature in the lifter to prevent the lifter from rotating about its longitudinal axis during reciprocation. Since the prior art anti-rotation guide resides above the block and occupies significant space, it may interfere with other engine components such as the cylinder head and intake manifold. Typically, a lifter is installed into its bore from the top side of the engine, and the anti-rotation guide is attached to the engine following lifter installation.

However, in some engines where the camshaft is embedded deeply inside the engine block, it is not possible for the lifters to be assembled from the top side of the block, and it may even be undesirable for an end of the lifter to be exposed above the block to be gripped by an anti-rotation guide installed on the top of the block as in the prior art. In such engines, the lifters must be installed from the bottom side of an engine block. Because of space constraints on the bottom side of an engine block, a conventional, externally mounted anti-rotation aperture guide cannot be readily adapted for use on the bottom side of the block.

Therefore, what is needed in the art is a compact anti-rotation guide that fits inside an engine block as a non-rotatable sleeve between a lifter body and a lifter bore.

What is further needed in the art is a compact anti-rotation guide that can be assembled into an engine from the bottom side, or camshaft side, of an engine block.

What is further needed in the art is a compact anti-rotation guide that can be assembled into an engine block before the corresponding valve lifter is installed.

What is still further needed in the art is a compact anti-rotation guide that also permits oil to flow to a lash-control element of a hydraulic valve lifter.

What is still further needed in the art is a compact anti-rotation guide-element comprising a plurality of individual anti-rotation guides, the element being kittable in a pre-assembly step.

It is a principal object of the present invention to provide lifter anti-rotation means that permits installation of a valve lifter from the bottom side of an engine block.

SUMMARY OF THE INVENTION

The present invention provides an anti-rotation guide for either a hydraulic or non-hydraulic roller follower valve lifter for an internal combustion engine. The guide is prevented from rotation within an engine bore by being press-fitted or otherwise constrained.

Briefly described, a guide in accordance with the invention is a generally cylindrical element having a tubular sleeve portion with an outer surface for engaging an engine bore and an inner surface for slidably receiving a valve lifter. One end of the guide includes an anti-rotation feature for cooperating with a mating feature on the lifter. The mating features are preferably flats, although other configurations are contemplated within the scope of the invention. The cooperating features prevent axial rotation of a lifter within the sleeve but do not inhibit axial or reciprocal motion of the lifter. The anti-rotation feature may take any of a plurality of shapes, including but not limited to an arm and tang, a flap, and an orifice flat.

BRIEF DESCRIPTION OF THE DRAWINGS

The present invention will now be described, by way of example, with reference to the accompanying drawings, in which.

DESCRIPTION OF THE PREFERRED EMBODIMENTS

Figure 1:
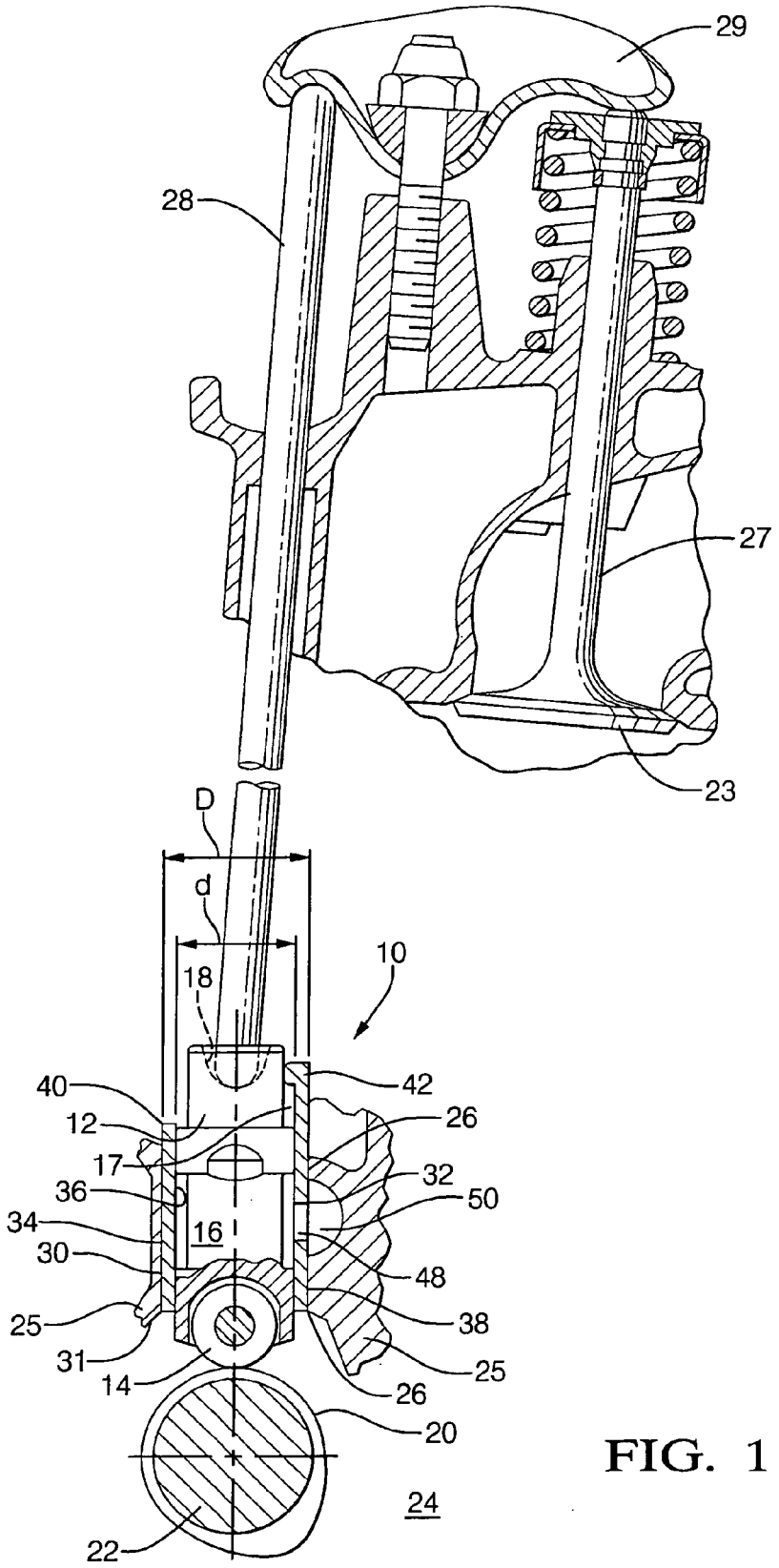
FIG. 1 is a cross-sectional view of a roller valve lifter assembly in accordance with the invention.

Corresponding reference characters indicate corresponding parts throughout the several views. The exemplifications set out herein illustrate a plurality of preferred embodiments of the invention, in a plurality of forms; however, such exemplifications are not to be construed as limiting the scope of the invention in any manner.

Referring to FIG. 1, there is shown a roller valve lifter assembly 10 of the present invention. Roller valve lifter assembly 10 includes roller valve lifter 12, and anti-rotation guide 30. Roller valve lifter 12 includes roller 14, lifter body 16, and seat 18. Seat 18 may receive a pushrod 28 as shown in FIG. 1 or alternatively and directly a valve stem 27 (without rocker arm assembly 29) in known fashion. Anti-rotation guide 30 includes generally cylindrical sleeve portion 32, outer surface 34, inside surface 36, first end 38 and second end 40. Second end 40 includes an anti-rotation feature 42 which will be described in more detail below. Preferably, anti-rotation guide 30 is formed of metal or plastic and may be machined, molded or cast in known fashion.

Diameter (D) of outer surface 34 is selected to be press fitted into lifter bore 26 of engine block 25 from opening 31 of bore 26. Optionally, (D) may be selected to allow a slip fit between sleeve portion 32 and bore 26. If a slip fit relationship is selected, a means for preventing rotation of the guide in the bore, such as for example a key and keyway, must be provided. An alternative for preventing guide rotation in bore 26 is discussed below. Diameter (d) of inside surface 36 of guide 30 is selected to receive roller valve lifter 12 slip-fittedly, to permit body 16 of lifter 12 to reciprocate freely within the guide in an axial direction. As shown in FIG. 1, when roller valve lifter assembly 10 is assembled into bore 26, anti-rotation guide 30 serves as an axial sleeve between lifter 12 and bore 26 to guide the axial reciprocation of, and prevent rotation of, lifter 12 within engine block 25.

Still referring to FIG. 1, in operation, roller 14 rides on a cam lobe 20 of camshaft 22 of internal combustion engine 24 and is displaced thereby. Roller 14 translates the rotary motion of the camshaft 22 to axial reciprocal motion of lifter body 16. The reciprocation of roller valve lifter 12 opens and closes valve 23, through push-rod 28, rocker arm 29, and valve stem 27, as is known in the art. The outer surface of lifter body 16 adjacent anti-rotation feature 42 includes an anti-rotation feature 17 for mating with feature 42. Feature 17 is preferably one or more flats; however, other configurations capable of cooperating with sleeve feature 42 to prevent rotation of the lifter within the sleeve are fully comprehended by the scope of the invention.

The axial length of guide 30, as shown in FIG. 1, may cause the anti-rotation feature 42 of the sleeve to extend above the surface of the engine block. In a currently-preferred embodiment, the length of guide 30 is selected such that anti-rotation feature 42 is contained within the length of block bore 26, although the relative length of guide 30 is not limited within the scope of the invention.

In a first embodiment 30*a* of an anti-rotation guide in accordance with the invention (FIG. 2), anti-rotation feature 42 includes arm 44 extending axially from second end 40 and tang 46 extending radially inward from arm 44. When lifter 12 is assembled into anti-rotation guide 30, at least one anti-rotation flat 17 of body 16 is aligned with edge 47 of anti-rotation guide 30 within which lifter body 16 is inserted. Thus, anti-rotation feature 42 limits axial rotation of lifter 12 in bore 26 during reciprocation of the lifter.

Figure 2:
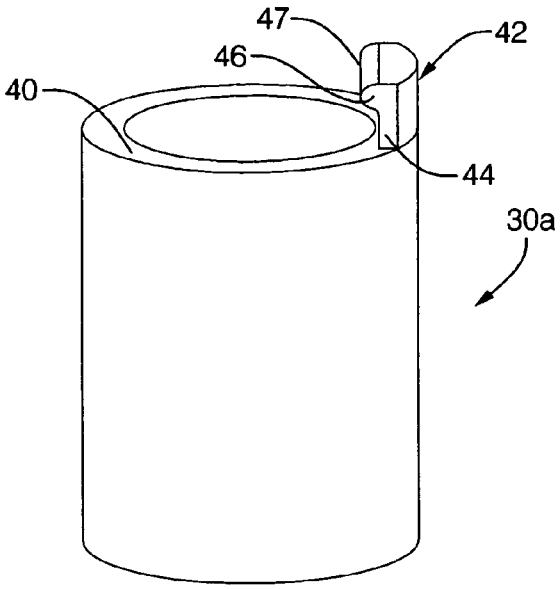
FIG. 2 is an isometric view of a first embodiment of an anti-rotation guide in accordance with the invention.
Figure 3:
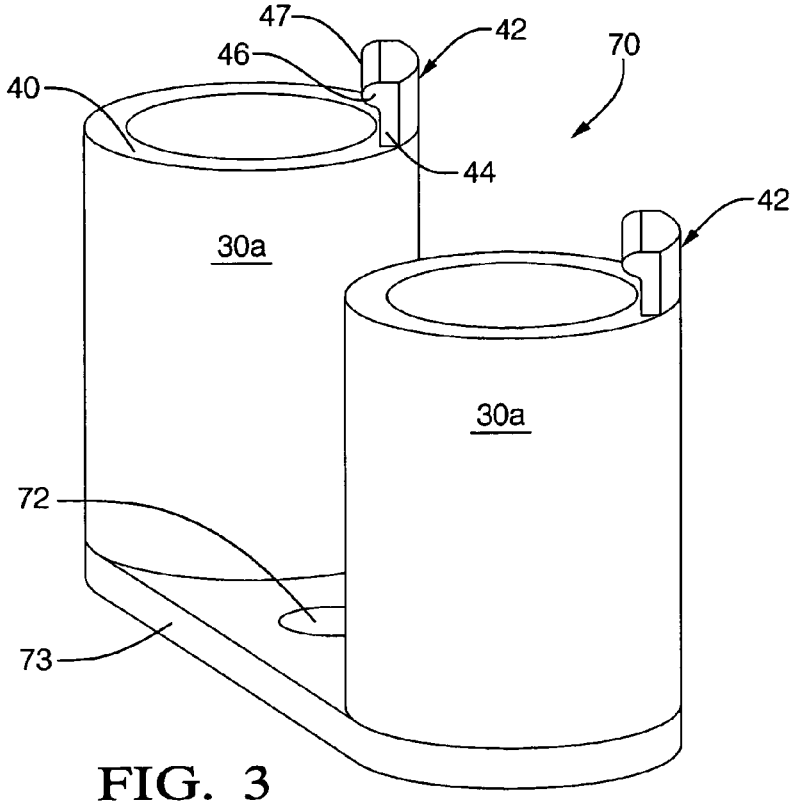
FIG. 3 is an isometric view of a second embodiment of an anti-rotation guide in accordance with the invention.

Referring to FIGS. 2 and 3, guide 30*a* may be conveniently provided in a ganged element 70 wherein a plurality of guides are formed conjointly for use with an equal number of lifters.

Figure 4:
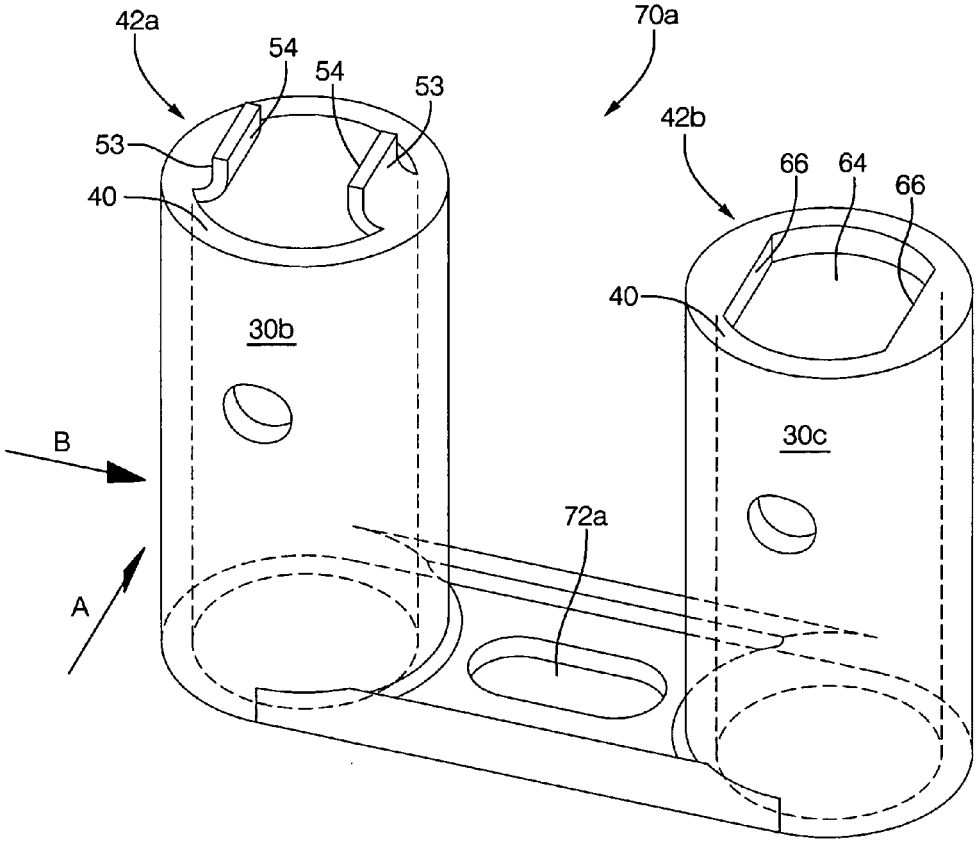
FIG. 4 is an isometric view of third and fourth embodiments.

An advantage of element 70, comprising in this currently-preferred embodiment two guides 30*a*, is that the two guides may be injection molded together from a heat-and oil-resistant plastic and mounted to engine 24 via a single bolt (not shown) through bolt hole 72 in connecting web 73. Hole 72 may be elongate, as shown in FIG. 4, to facilitate bolting of the guide to the engine block.

Another advantage is that two-guide element 70 also permits two appropriate lifters to be pre-assembled as a kit and then installed simultaneously into engine 24.

Still another advantage is that, when two or more guides are ganged in this fashion, only a slip fit between sleeve portion 32 and bore 26 is needed since intermediate web 73 prevents rotation of the guides in their respective bores.

Still another advantage is that element 70 assures proper initial and continuing orientation of each lifter assembly 10, and especially its roller 14, with respect to its cam lobe 20.

Referring to FIG. 4, in a second embodiment 30*b* of an anti-rotation guide, anti-rotation feature 42*a* includes flaps 53 extending axially from second end 40. When lifter 12 is assembled into the anti-rotation guide, at least one flat surface 54 is aligned with at least one flat 17 of lifter body 16.

Still referring to FIG. 4, in a third embodiment 30*c* of an anti-rotation guide, anti-rotation feature 42*b* includes orifice 64 disposed in second end 40 and opposing orifice flats 66. When lifter 12 is assembled into the anti-rotation guide, opposing flats 66 are aligned with flats 17 of lifter body 16. (For convenience in presentation, embodiments 30*b* and 30*c* are shown together in a single element 70*a*, although in practice the element would likely comprise one or the other but not both.)

Figure 5:
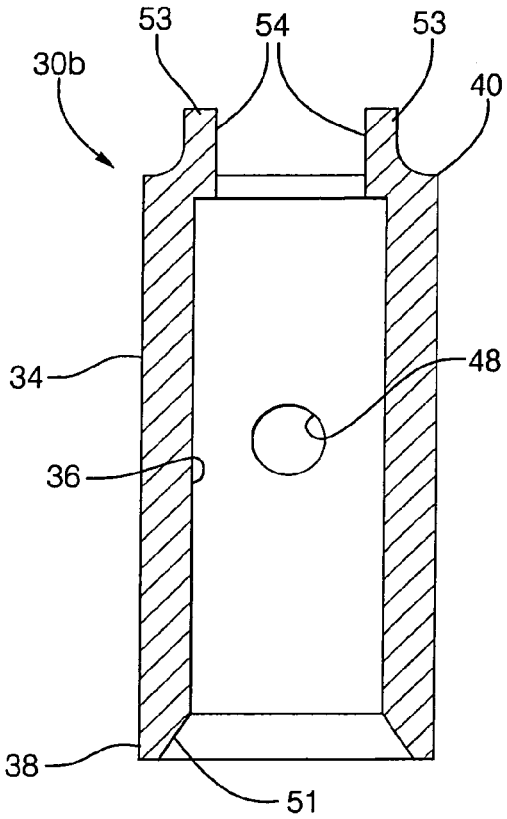
FIG. 5 is an axial cross-sectional view of guide 30*b* shown in FIG. 4, as viewed along "A"
Figure 6:
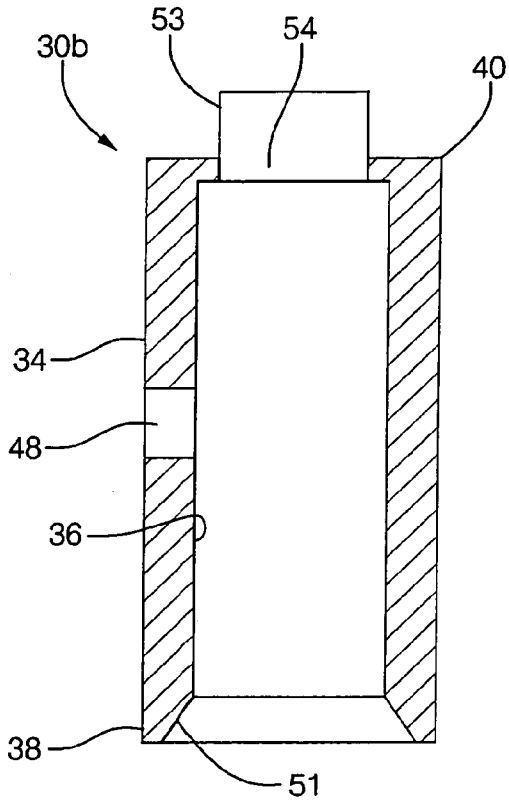
FIG. 6 is an axial cross-sectional view of guide 30*b* shown in FIG. 4, as viewed along "B"
Figure 7:
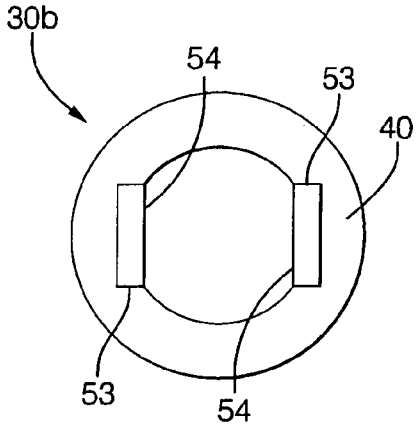
FIG. 7 is a plan view of the guide 30*b* shown in FIG. 4.
Figure 8:
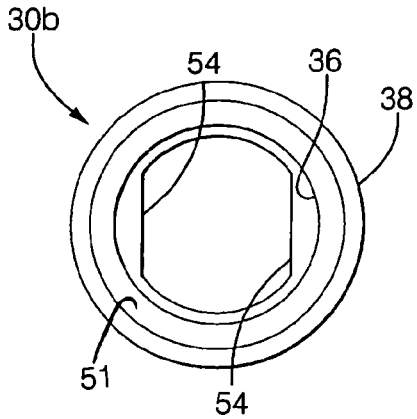
FIG. 8 is a bottom view of the guide 30*b* shown in FIG. 4.

Referring to FIGS. 5 through 8, various views are shown of an individual anti-rotation guide 30*b*, such as has already been shown in ganged form in FIG. 4, and the parts are so indicated. FIG. 5 is an axial cross-sectional view, and FIG. 6 is a similar axial cross-sectional view taken orthogonally to the view shown in FIG. 5. FIG. 7 is a plan view of guide 30*b*, and FIG. 8 is a bottom view thereof. Note that guide inner surface 36 is preferably chamfered 51 at first end 38 to facilitate entry of lifter 12 into guide 30 during engine assembly.

Optionally, roller valve lifter 12 may include a hydraulic lash adjuster member (not shown). As is well known in the art, a means for communicating oil from an engine oil gallery to the hydraulic lash adjuster member is needed such as, for example, an oil feed orifice through the wall of body 16 of lifter 12. Referring to FIGS. 1,5,6, oil aperture 48 in sleeve portion 32 of guide 30 communicates oil from engine oil gallery 50 to the lash adjuster. The size of aperture 30 can be easily and selectively formed in sleeve 32 in order to accurately regulate the oil transferred to the lash adjuster member.

While the invention has been described by reference to various specific embodiments, it should be understood that numerous changes may be made within the spirit and scope of the inventive concepts described. Accordingly, it is intended that the invention not be limited to the described embodiments, but will have full scope defined by the language of the following claims.

What is claimed is:

1. An anti-rotation guide for a valve lifter for an internal combustion engine having a camshaft disposed within an engine block of said engine, and a valve train, comprising:

a) a sleeve portion having an inner surface and an outer surface and a first end and a second end; and b) an anti-rotation feature fixedly coupled to one of said first end and said second end of said sleeve portion for cooperating with said lifter to prevent axial rotation of said lifter within said guide, wherein said anti-rotation feature is one of an arm and tang or a flap, said sleeve portion being oriented when installed from an opening of a bore in said engine proximate said camshaft, said first end of said sleeve portion being adjacent said camshaft and said second end of said sleeve portion being adjacent said valve train.

2. A guide in accordance with claim 1 wherein a diameter of said outer surface is selected such that said guide is configured to be press-fit into said engine bore.

3. A guide in accordance with claim 1 wherein a diameter of said outer surface is selected such that said guide is configured to be slip-fit into said engine bore.

4. A guide in accordance with claim 1 comprising a plurality of said sleeve portions connected at said first ends thereof, each sleeve portion having an anti-rotation element disposed at a second end thereof, wherein said guide may be used with a plurality of valve lifters in a plurality of said bores in said engine.

5. A guide in accordance with claim 4 further comprising means for attaching said guide to said engine.

6. A guide in accordance with claim 1 wherein said lifter is selected from the group consisting of solid lifter and hydraulic lifter.

7. A guide in accordance with claim 1 wherein said valve train includes a rocker arm assembly.

8. A guide in accordance with claim 1 further comprising an oil aperture communicating an engine oil gallery with said lifter.

9. An internal combustion engine having a camshaft and a valve train and a valve lifter, said engine comprising:

an anti-rotation guide for receiving said valve lifter, including, a sleeve portion having an inner surface and an outer surface and a first end and a second end, and an anti-rotation feature fixedly coupled to one of said first end and said second end of said sleeve portion for cooperating with said lifter to prevent axial rotation of said valve lifter, wherein said anti-rotation feature includes one of an arm and tang or a flap, said sleeve portion being oriented when installed from an opening of a bore in said engine proximate said camshaft, said first end of said sleeve portion being adjacent said camshaft and said second end of said sleeve portion being adjacent said valve train.

10. A guide in accordance with claim 9 wherein said arm extends axially from one of said first end and said second end of said sleeve, and wherein said tang extends inwardly from said arm.

11. An internal combustion engine having a camshaft and a valve train and a valve lifter, said engine comprising:

an anti-rotation guide for receiving said valve lifter, including, a sleeve portion having an inner surface and an outer surface and a first end and a second end, and an anti-rotation feature fixedly coupled to and integrally formed with one of said first end and said second end of said sleeve portion for cooperating with said lifter to prevent axial rotation of said valve lifter, wherein said anti-rotation feature includes at least one orifice flat, said sleeve portion being oriented when installed from an opening of a bore in said engine proximate said camshaft, said first end of said sleeve portion being adjacent said camshaft and said second end of said sleeve portion being adjacent said valve train.

12. A guide in accordance with claim 1 wherein said sleeve portion is removable from said bore in said engine.

13. A guide in accordance with claim 11, wherein said anti-rotation feature includes two opposing orifice flats.

* * * * *